US007094023B2

(12) United States Patent
Dube et al.

(10) Patent No.: US 7,094,023 B2
(45) Date of Patent: Aug. 22, 2006

(54) SHROUD HONEYCOMB CUTTER

(75) Inventors: Bryan P. Dube, Columbia, CT (US); Richard Page, Guilford, CT (US)

(73) Assignee: United Technologies Corporation, Hartford, CT (US)

( * ) Notice: Subject to any disclaimer, the term of this patent is extended or adjusted under 35 U.S.C. 154(b) by 227 days.

(21) Appl. No.: 10/774,824

(22) Filed: Feb. 9, 2004

(65) Prior Publication Data

US 2005/0175453 A1 Aug. 11, 2005

(51) Int. Cl.
*F01D 11/08* (2006.01)

(52) U.S. Cl. ..... 415/173.1; 415/173.6; 416/189; 416/191; 416/192

(58) Field of Classification Search ..... 415/173.1, 415/173.4, 173.5, 173.6, 228; 416/189, 190, 416/191, 192, 195
See application file for complete search history.

(56) References Cited

U.S. PATENT DOCUMENTS 6,491,498 B1 12/2002 Seleski et al.
6,805,530 B1 * 10/2004 Urban ..... 415/173.4
6,913,445 B1 * 7/2005 Beddard et al. ..... 416/192

FOREIGN PATENT DOCUMENTS

JP 08-303204 11/1996

* cited by examiner

*Primary Examiner*—Edward K. Look
*Assistant Examiner*—Dwayne J White
(74) *Attorney, Agent, or Firm*—Bachman & LaPointe, P.C.

(57) ABSTRACT

A turbine blade for use in a gas turbine engine is provided. The turbine blade includes an airfoil portion having a tip end, a shroud attached to the tip end, which shroud has an outer surface, and a knife edge attached to an outer surface of the shroud. The knife edge has a pair of cutter blades protruding outwardly from the knife edge.

20 Claims, 3 Drawing Sheets

SHROUD HONEYCOMB CUTTER

BACKGROUND OF THE INVENTION (a) Field of the Invention

The present invention relates to gas turbine engines, and more particularly, to a turbine blade for use in such engines.

(b) Prior Art

Gas turbine blades are rotating airfoil shaped components in series of stages designed to convert thermal energy from a combustor into mechanical work of turning a rotor. Performance of a turbine can be enhanced by sealing the outer edge of the blade tip to prevent combustion gases from escaping from the flowpath to the gaps between the blade tip and the outer casing. A common manner of sealing the gap between the blade tips and the turbine casing is through blade tip shrouds.

A feature of a typical turbine blade shroud is a knife edge. Depending upon the size of the blade shroud, one or more knife edges may be utilized. The purpose of the knife edge(s) is to engage honeycomb material located on the inner surface of the outer casing to further minimize any leakage around the blade tip. One typical type of knife edge is shown in U.S. Pat. No. 6,491,498 to Seleski et al.

In some shroud configurations, the knife blade is provided with one or more cutting blades which cut the honeycomb material as the blade rotates. Japanese Patent Publication No. 8-303204 illustrates a knife blade having such cutting blades with one of the cutting blades being at an end of the knife edge and the other being removed from the end of the knife edge.

Often, prior art shrouds having knife edge sealing arrangements suffer from a life shortfall as a result of creep initiated by the extra mass of the cutter feature being located at an outer edge of the shroud. Thus, there is need for an improved shroud construction which meets all sealing requirements, and yet does not suffer from creep which shortens the life of the shroud.

SUMMARY OF THE INVENTION

Accordingly, it is an object of the present invention to provide an improved shroud arrangement for a turbine blade.

It is yet another object of the present invention to provide an improved shroud arrangement as above which does not suffer from creep life shortfall.

It is still another object of the present invention to provide a method for forming a shroud arrangement having a knife edge with cutting blades machined therein.

The foregoing objects are attained by the shroud honeycomb cutter of the present invention and the method of making same.

In accordance with the present invention, a turbine blade is provided having an airfoil with a tip end and a shroud attached to the tip end. The shroud has a knife edge with a pair of cutting blades preferably machined therein. The knife edge is preferably attached to an outer surface of the shroud. The pair of cutting blades protrude outwardly from the knife edge.

Further in accordance with the present invention, a method for manufacturing a turbine blade is provided. The method broadly comprises the steps of forming a turbine blade having an airfoil portion, a shroud attached to a tip end of the airfoil portion, and a knife edge attached to an outer surface of the shroud, and machining a pair of cutter blades into the knife edge so that the cutter blades are positioned over the airfoil portion.

Other details of the shroud honeycomb cutter of the present invention, as well as other objects and advantages attendant thereto, are set forth in the following detailed description and the accompanying drawings wherein like reference numerals depict like elements.

DETAILED DESCRIPTION OF THE PREFERRED EMBODIMENT(S)

Figure 1:
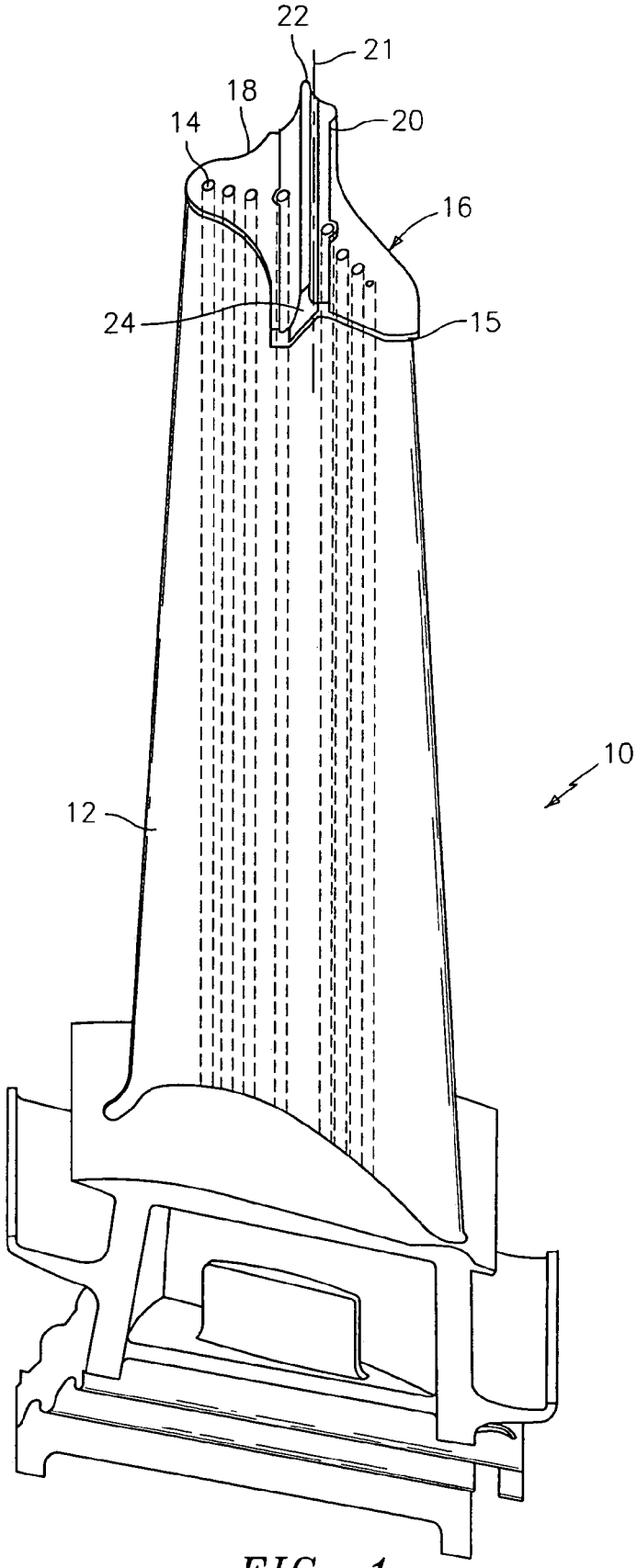
FIG. 1 is a perspective view of a turbine blade having the shroud arrangement of the present invention.

Referring now to the drawings, FIG. 1 illustrates a turbine blade 10 for use in a gas turbine engine. The turbine blade 10 has an airfoil portion 12 which typically contains a plurality of internal cooling passageways 14. The airfoil portion 12 has a tip end 15 to which a shroud 16 is attached. The shroud 16 is shaped to mate with like shrouds on adjacent turbine blades so as to prevent combustion gases from leaking around the turbine blade 10.

As can be seen from FIG. 1, the shroud 16 has an outer surface 18 on which a knife edge 20 is attached. The knife edge 20 is substantially linear in shape and has a longitudinal axis 22 which intersects the chord line of the airfoil portion 12 at an angle. The knife edge 20 may have any desired width and/or height. The knife edge 20 terminates in ends 22 and 24.

The turbine blade 10 with the airfoil portion 12, the shroud 16, and the knife edge 20 may be formed using any suitable technique known in the art. For example, the turbine blade 10 may be a cast blade with the airfoil portion 12 and the shroud 16. The blade 10 has a knife edge 20 which is typically machined. Alternatively, the turbine blade 10 with the airfoil portion 12 may be separated cast from the shroud 16 and the shroud 16 may be separately cast from the knife edge 20. In such a scenario, these components may be assembled in any suitable manner known in the art.

Figure 2:
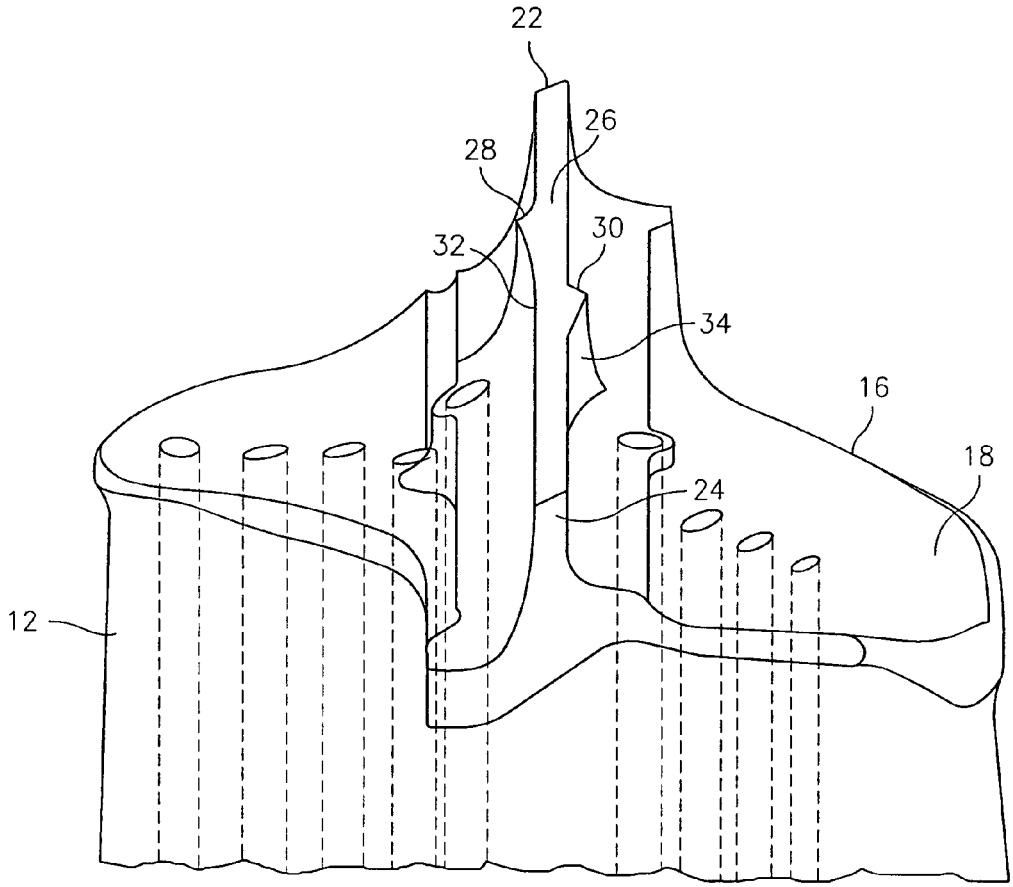
FIG. 2 is an enlarged perspective view of the shroud arrangement of FIG. 1.
Figure 3:
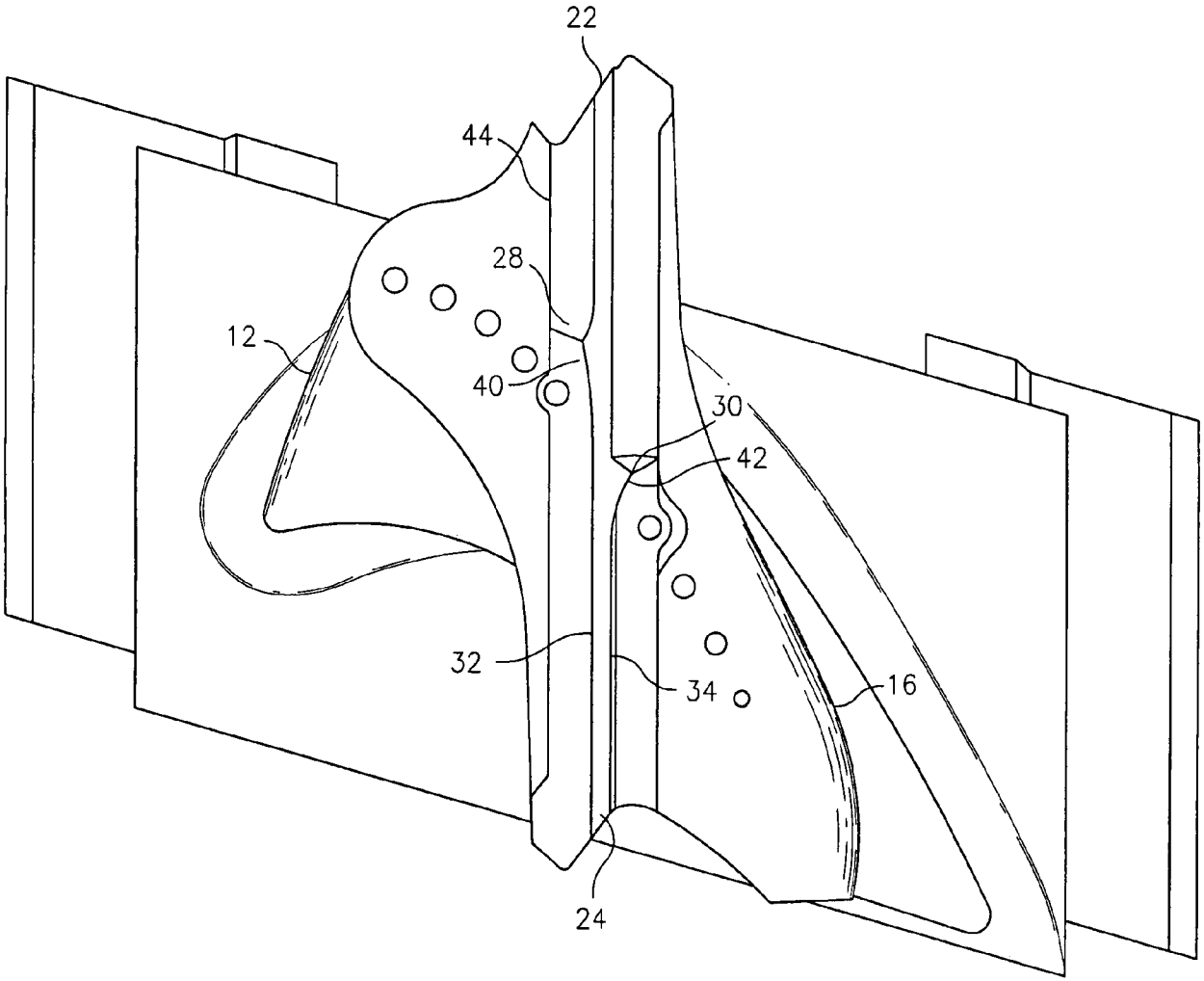
FIG. 3 is a top view of the shroud arrangement of FIG. 1 showing a knife edge with cutter blades in accordance with the present invention.

Referring now to FIGS. 2 and 3, the knife edge 20 has a central region 26 which is spaced from the ends 22 and 24. In this central region 26, a pair of cutter blades 28 and 30 are formed by machining out portions of the knife edge 20. Any suitable machining device known in the art may be used to form the cutter blades 28 and 30. As can be seen from this figure, the cutter blade 28 protrudes outwardly from a first side 32 of the knife edge 20, while the cutter blade 30 protrudes outwardly from a second opposed side 34 of the knife edge 20. In a preferred embodiment of the present invention, the cutter blade 28 is staggered with respect to the cutter blade 30. Further, both cutter blades 28 and 30 are positioned over the airfoil portion 12.

One of the advantages to machining the cutter blades 28 and 30, instead of forming them via a casting process, is that one is able to get sharper cutting edges. In the context of the present invention, each of the cutter blades 28 and 30 has a cutting edge 40 and 42 respectively which is oriented at an angle, preferably an obtuse angle, with respect to the longitudinal axis 22 of the knife edge 20. Because the cutter blades 28 and 30 have sharper cutting edges 40 and 42, there is more interaction with the honeycomb (not shown) attached to an inner surface of the outer casing which improves the seal between the outer casing and the turbine blade.

As can be seen in FIGS. 2 and 3, machining of the cutter blades 28 and 30 results in the knife edge 20 having a base portion 44 which is wider than the upper edge 46 of the knife edge 20. This is beneficial from the standpoint of reducing the mass of the knife edge 20 while providing the desired cutter blades 28 and 30 with the sharper cutting edges 40 and 42.

One of the benefits of the improved knife edge design of the present invention is that the cutter blades 28 and 30 are substantially positioned over the airfoil portion 12 in a manner which best balances shroud load over the airfoil portion. This is advantageous because the mass of the "cutter" is moved to a more balanced area above the shroud. As a result, there is an improvement in preventing creep from shortening the life of the shroud. Additionally, there is an improvement in that the curling which occurs due to the extra-mass of the cutter feature being located at an outer edge of the shroud is avoided. The ability to form the knife edge and the cutter blades by machining is advantageous because the knife edge may be thinner than in other designs, resulting in a lightweight knife edge which also improves shroud creep and airfoil creep.

The cutting blades 28 and 30 in accordance with the present invention are designed to cut the honeycomb (not shown) attached to the inner surface of the outer casing fore and aft.

In operation, the turbine blade 10 is rotated. As the temperature of the engine arises, the cutter blades 28 and 30 interact with the honeycomb attached to the outer casing to maintain a seal which prevents the leakage of combustion gases around the turbine blade 10.

It is apparent that there has been provided in accordance with the present invention a shroud honeycomb cutter which fully satisfies the objects, means, and advantages set forth hereinbefore. While the present invention has been described in the context of specific embodiments thereof, other alternatives, modifications, and variations will become apparent to those skilled in the art having read the foregoing description. Accordingly, it is intended to embrace those alternatives, modifications, and variations as fall within the broad scope of the appended claims.

What is claimed is:

1. A turbine blade for use in a gas turbine engine, said turbine blade comprising:

an airfoil portion having a tip end;

a shroud attached to said tip end, said shroud having an outer surface;

a knife edge attached to said outer surface of said shroud; and said knife edge having a pair of cutter blades protruding outwardly from said knife edge.

2. The turbine blade of claim 1, wherein said pair of cutter blades are located in a central region of said knife edge and remote from each end of said knife edge.

3. The turbine blade of claim 1, wherein said cutter blades are staggered with respect to each other.

4. The turbine blade of claim 1, wherein said cutter blades are positioned in a manner to best balance shroud load over the airfoil portion.

5. The turbine blade according to claim 1, wherein said pair of cutter blades include a first cutter blade protruding from a first side of said knife edge and a second cutter blade protruding from a second side of said knifed edge opposed to said first side.

6. The turbine blade according to claim 5, wherein said knife edge is integrally formed with said shroud and wherein each of said cutter blades is machined into said integrally formed knife edge.

7. The turbine blade according to claim 5, wherein said knife edge has a longitudinal axis and each of said first and second cutter blades has a cutting edge which is at an angle with respect to said longitudinal axis.

8. The turbine blade according to claim 7, wherein said angle is an obtuse angle.

9. The turbine blade according to claim 1, further comprising a plurality of cooling holes extending through said airfoil portion.

10. A shroud for a turbine blade, said shroud having an outer surface, a knife edge attached to said outer surface, and a plurality of cutter blades formed into said knife edge at a central location spaced from each end of said knife edge.

11. A shroud according to claim 10, wherein said cutter blades are staggered.

12. A shroud according to claim 11, wherein said cutter blades include a first cutter blade protruding from a first side of said knife edge and a second cutter blade protruding from a second side of said knife edge.

13. A shroud according to claim 12, wherein said first side of said knife edge is opposed to said second side of said knife edge.

14. A shroud according to claim 12, wherein said knife edge has a longitudinal axis and said first cutter blade has a cutting edge at an angle to said longitudinal axis.

15. A shroud according to claim 14, wherein said second cutter blade has a cutting edge at an angle to said longitudinal axis.

16. A method for manufacturing a turbine blade comprising:

forming a turbine blade having an airfoil portion, a shroud attached to a tip end of said airfoil portion, and a knife edge attached to an outer surface of said shroud; and machining a pair of cutter blades into said knife edge so that said cutter blades are positioned substantially over said airfoil portion.

17. A method according to claim 16, wherein said machining step comprises machining a first cutter blade on a first side of said knife edge and machining a second cutter blade on a second side of said knife edge.

18. A method according to claim 16, wherein said machining step comprises machining said cutter blades so that said cutter blades are staggered along a longitudinal axis of said knife edge.

19. A method according to claim 16, wherein said forming step comprises casting a turbine blade having said airfoil portion and said shroud, and machining said knife edge.

20. The turbine blade of claim 1, wherein each of said cutter blades is positioned over said airfoil portion.

* * * * *